US010590729B2

(12) United States Patent
Shampine

(10) Patent No.: US 10,590,729 B2
(45) Date of Patent: Mar. 17, 2020

(54) SHARABLE DEPLOYMENT BARS WITH MULTIPLE PASSAGES AND CABLES

(71) Applicant: SCHLUMBERGER TECHNOLOGY CORPORATION, Sugar Land, TX (US)

(72) Inventor: Rod William Shampine, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 15/550,495

(22) PCT Filed: Feb. 10, 2016

(86) PCT No.: PCT/US2016/017254
§ 371 (c)(1),
(2) Date: Aug. 11, 2017

(87) PCT Pub. No.: WO2016/130619
PCT Pub. Date: Aug. 18, 2016

(65) Prior Publication Data

US 2018/0030801 A1 Feb. 1, 2018

Related U.S. Application Data

(60) Provisional application No. 62/115,750, filed on Feb. 13, 2015.

(51) Int. Cl.
*E21B 33/06* (2006.01)
*E21B 33/03* (2006.01)
(Continued)

(52) U.S. Cl.
CPC ..... *E21B 33/061* (2013.01); *E21B 19/22* (2013.01); *E21B 33/03* (2013.01); *E21B 33/06* (2013.01); *E21B 33/068* (2013.01)

(58) Field of Classification Search
CPC ..... E21B 33/061; E21B 19/22; E21B 33/068; E21B 33/03; E21B 33/06
See application file for complete search history.

(56) References Cited

U.S. PATENT DOCUMENTS 4,325,434 A 4/1982 Roberts
4,940,095 A 7/1990 Newman
(Continued)

FOREIGN PATENT DOCUMENTS

WO 2001020129 A2 3/2001
WO 2010064920 A1 6/2010
(Continued)

OTHER PUBLICATIONS

International Search Report and Written Opinion issued in International Patent Appl. No. PCT/US2016/017254 dated May 3, 2016; 14 pages.
(Continued)

*Primary Examiner* — Yong-Suk Ro
(74) *Attorney, Agent, or Firm* — Cathy Hewitt

(57) ABSTRACT

Apparatus for deploying coiled tubing into a wellbore include a neck portion extending between end connections, where the end connections are configured to be attached to a coiled tubing tool string, and a main flow passage, at least one secondary flow passage and at least one electrical device passageway extending through the neck portion and the end connections. A wireline cable or an optical fiber is disposed in the electrical device passageway, and a well treatment fluid flows through the main flow passage. The main flow passage may have a substantially circular cross sectional shape. The apparatus includes at least one secondary flow passage having a substantially circular cross sectional shape, which may be a tube disposed within the main flow passage.
(Continued)

The electrical device passageway may in some cases be a tube disposed within the main flow passage.

21 Claims, 6 Drawing Sheets

(51) Int. Cl.
*E21B 33/068* (2006.01)
*E21B 19/22* (2006.01)

(56) References Cited

U.S. PATENT DOCUMENTS

| | | | | |
|---|---|---|---|---|
| 6,050,338 | A | 4/2000 | Watkins | |
| 6,164,619 | A | 12/2000 | Van Winkle et al. | |
| 6,192,983 | B1 | 2/2001 | Neuroth et al. | |
| 6,209,652 | B1 | 4/2001 | Portman et al. | |
| 6,913,084 | B2 | 7/2005 | Boyd | |
| 7,814,972 | B2 * | 10/2010 | Angman | E21B 33/068 166/117.5 |
| 8,047,295 | B2 * | 11/2011 | Skeels | E21B 33/076 166/348 |
| 8,146,660 | B2 | 4/2012 | Irani et al. | |
| 9,080,412 | B2 * | 7/2015 | Wetzel | E21B 43/128 |
| 2004/0104024 | A1 | 6/2004 | Kent et al. | |
| 2007/0051512 | A1 | 3/2007 | Markel et al. | |
| 2007/0137866 | A1 | 6/2007 | Ravensbergen et al. | |
| 2007/0162235 | A1 | 7/2007 | Zhan et al. | |
| 2009/0084558 | A1 | 4/2009 | Bloom | |
| 2009/0260804 | A1 | 10/2009 | Mydur et al. | |
| 2010/0104372 | A1 | 4/2010 | Lawson et al. | |
| 2010/0155054 | A1 | 6/2010 | Innes et al. | |
| 2010/0163243 | A1 | 7/2010 | Sbordone | |
| 2010/0230112 | A1 | 9/2010 | Cox et al. | |
| 2011/0267922 | A1 | 11/2011 | Shampine et al. | |
| 2011/0272148 | A1 | 11/2011 | Lovell et al. | |
| 2012/0125622 | A1 | 5/2012 | Melancon et al. | |
| 2013/0341539 | A1 | 12/2013 | Hughes et al. | |
| 2014/0048256 | A1 | 2/2014 | Ringgenberg | |
| 2014/0166270 | A1 | 6/2014 | Varkey et al. | |
| 2014/0231075 | A1 | 8/2014 | Springett et al. | |
| 2016/0215584 | A1 | 7/2016 | Tennant | |

FOREIGN PATENT DOCUMENTS

| | | | |
|---|---|---|---|
| WO | 2014074099 | A1 | 5/2014 |
| WO | 2016130612 | A1 | 8/2016 |
| WO | 2016130617 | A1 | 8/2016 |
| WO | 2016130620 | A1 | 8/2016 |

OTHER PUBLICATIONS

International Search Report and Written Opinion issued in International Patent Appl. No. PCT/US2016/017259 dated Apr. 25, 2016; 25 pages.
International Search Report and Written Opinion issued in International Patent Appl. No. PCT/US2016/017256 dated May 3, 2016; 17 pages.
International Search Report and Written Opinion issued in International Patent Appl. No. PCT/US2016/017250 dated May 11, 2016; 10 pages.
International Search Report and Written Opinion issued in International Patent Appl. No. PCT/US2016/017243 dated May 17, 2016; 11 pages.

* cited by examiner

SHARABLE DEPLOYMENT BARS WITH MULTIPLE PASSAGES AND CABLES

RELATED APPLICATION INFORMATION

This Patent Document claims priority under 35 U.S.C. § 120 to U.S. Provisional Patent Application No. 62/115,750 filed Feb. 13, 2015, the entire disclosure of which is incorporated by reference herein in its entirety.

FIELD

The present disclosure is related in general to wellsite equipment such as oilfield surface equipment, downhole assemblies, coiled tubing (CT) assemblies, slickline and assemblies, and the like.

BACKGROUND

Coiled tubing is a technology that has been expanding its range of application since its introduction to the oil industry in the 1960's. Its ability to pass through completion tubulars and the wide array of tools and technologies that can be used in conjunction with it make it a very versatile technology.

Typical coiled tubing apparatus includes surface pumping facilities, a coiled tubing tool string mounted on a reel, a method to convey the coiled tubing into and out of the wellbore, such as an injector head or the like, and surface control apparatus at the wellhead. Coiled tubing has been utilized for performing well treatment and/or well intervention operations in existing wellbores such as, but not limited to, hydraulic fracturing, matrix acidizing, milling, perforating, coiled tubing drilling, and the like.

In spooled conveyance services such as coiled tubing, wireline, and slickline, downhole tools need to be transferred from the reel at atmospheric pressure to inside the wellbore at wellbore pressure, in a process referred to as coiled tubing deployment. This transfer may be accomplished using a long riser with the conveyance attached to the top of the long riser. In this method, the tools are either pulled into the bottom of this riser, or are assembled into it. The riser is then attached to the well, is pressure tested, then the tools are run into the well. In an embodiment, an 'easier to run' service is utilized to place the tools in the well, followed by a 'harder to run' service do the running in hole. In this embodiment, the downhole tools are provided with an additional part known as a deployment bar. This deployment bar is intended to provide a surface against which the blowout preventers (BOPs) can both grip and seal. In the case where the 'harder to run' service is coiled tubing, wireline or slickline may be used to pre-place the tools in the coiled tubing BOP. The deployment bar used will be selected to have a diameter substantially equal to the coiled tubing diameter. As part of the contingency plans, it must always be possible to close the master valves of the BOP. In order to do this while the downhole tools are hanging in the BOPs, and without opening the well to atmosphere (thereby creating a blowout), the deployment bar must be capable of being sheared by the shear ram in the BOP. Once this is done, the slip and pipe rams can be opened and the tool dropped into the well.

It remains desirable to provide improvements in oilfield surface equipment and/or downhole assemblies such as, but not limited to, methods and/or systems for deploying coiled tubing into wellbores such as improved deployment bars for coiled tubing deployment.

SUMMARY

This section provides a general summary of the disclosure, and is not a necessarily a comprehensive disclosure of its full scope or all of its features.

In a first aspect of the disclosure, apparatus for deploying coiled tubing into a wellbore include a neck portion extending between end connections, where the end connections are configured to be attached to a coiled tubing tool string, and a main flow passage, at least one optional secondary flow passage and at least one electrical device passageway extending through the neck portion and the end connections. In some aspects, a wireline cable or an optical fiber is disposed in the electrical device passageway, and a well treatment fluid flows through the main flow passage. The main flow passage may have a substantially circular cross sectional shape. In some aspects, the apparatus includes at least one secondary flow passage having a substantially circular cross sectional shape, which may be a tube disposed within the main flow passage. The electrical device passageway may in some cases be a tube disposed within the main flow passage. In some other aspects, the main flow passage, the at least one secondary flow passage and the electrical device passageway are isolated by contiguous walls. The apparatus may be sheared by at least one shearing ram disposed in a blowout preventer which provides a clean cut that which is substantially perpendicular to the longitudinal axis of apparatus, where the main flow passage is substantially open to the wellbore, and where the shearing ram seals the pressure of the wellbore from the atmosphere after the clean cut.

In another aspect of the disclosure, methods include providing an apparatus having a neck portion extending between a first and a second end connection, where the end connections are configured to be attached to a coiled tubing tool string. The apparatus further includes a main flow passage, at least one optional secondary flow passage and at least one electrical device passageway extending through the neck portion and the end connections. A tool is attached to the first end connection of the apparatus, and the tool are introduced into a blow out preventer, a wellhead and a wellbore. The apparatus may be secured with one or more sealing rams contained with the blow out preventer, and the coiled tubing tool string attached to the second end connection of the apparatus. The coiled tubing tool string, the apparatus and the tool may then be deployed into the wellbore. A well treatment fluid may then be pumped into the wellbore through the main flow passage, a second fluid may be transmitted through the at least one secondary flow passage, and power may be provided to the tool through a wireline cable disposed in the least one electrical device passageway.

In yet another aspect of the disclosure, methods include providing an apparatus including a neck portion extending between a first and a second end connection, where the end connections are configured to be attached to a coiled tubing tool string. The apparatus further includes a main flow passage, at least one secondary flow passage and at least one electrical device passageway extending through the neck portion and the end connections. A tool is attached to the first end connection of the apparatus, the apparatus and the tool introduced into a blow out preventer, a wellhead and a wellbore, and the apparatus then secured with one or more sealing rams contained with the blow out preventer. The apparatus may be sheared by at least one shearing ram disposed in the blowout preventer to provide a clean cut which is substantially perpendicular to the longitudinal axis of apparatus, and where the shearing ram seals the pressure of the wellbore from the atmosphere. The one or more sealing rams may be opened, and the tool and apparatus dropped into the wellbore.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

The following description of the variations is merely illustrative in nature and is in no way intended to limit the scope of the disclosure, its application, or uses. The description and examples are presented herein solely for the purpose of illustrating the various embodiments and should not be construed as a limitation to the scope and applicability of such. Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present). In addition, use of the "a" or "an" are employed to describe elements and components of the embodiments herein. This is done merely for convenience and to give a general sense of concepts according to the disclosure. This description should be read to include one or at least one and the singular also includes the plural unless otherwise stated. The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited. Also, as used herein any references to "one embodiment" or "an embodiment" means that a particular element, feature, structure, or characteristic described in connection with the embodiment is included in at least one embodiment. The appearances of the phrase "in one embodiment" in various places in the specification are not necessarily referring to the same embodiment.

Figure 1D:
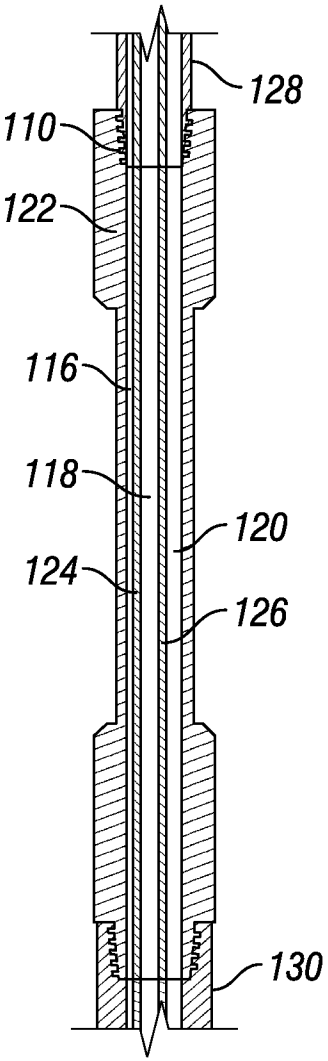
FIGS. 1C and 1D depict another embodiment of a deployment bar in a cross-sectional view, in accordance with an aspect of the disclosure.
Figure 1C:
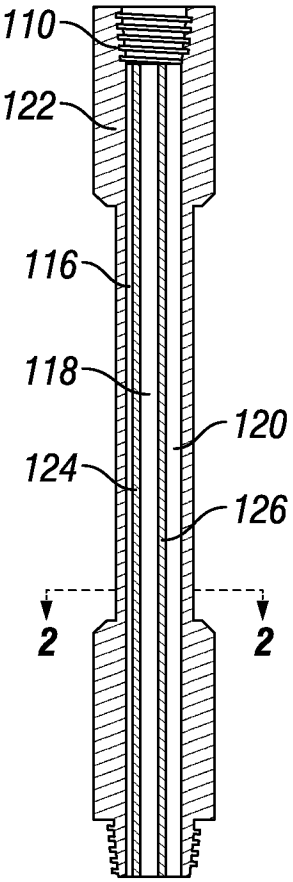

Embodiments of the present disclosure provide methods and/or systems of using a deployment bar that is designed to maximize its ability to be sheared while delivering at least one flow passage and at least one electrical wire therethrough. Referring to FIG. 1A, generally outer features of a deployment bar 100 include a neck portion 102, and larger diameter end connections 104 and 106. The neck 102 is generally sized to match the diameter of coiled tubing as well as sized to match the inner passageway diameter of a deployment blow out preventer. End connection 106 may have a mechanism for connecting with a tool, such as a male threaded connection 108 disposed on the distal end of connection end 106. Likewise, end connection 104 may have a mechanism, such as a female threaded connection 110, shown in FIGS. 1B and 1C, on a distal end for connecting with a tool, coiled tubing and/or deployment device, such as coiled tubing, wireline, or slickline. While a female threaded connection and male threaded connection are described, it is within the scope of the disclosure to use any combination of threaded connections, such as two female connections, two male connections, or male/female connections at opposite ends than depicted.

Figure 1B:
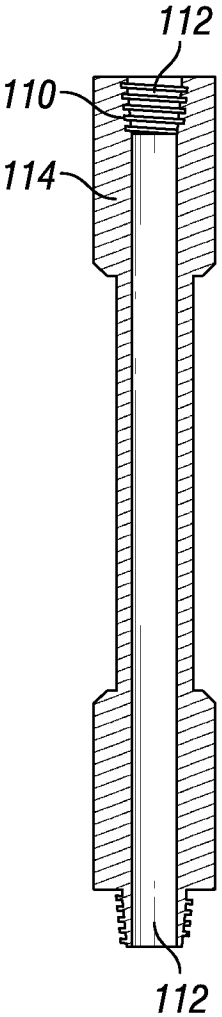
FIG. 1B shows a deployment bar in a cross-sectional view, according to the disclosure.
Figure 1A:
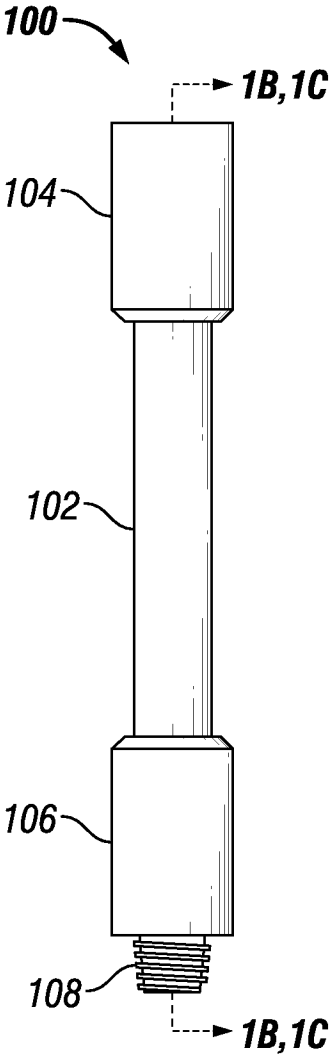
FIG. 1A illustrates a general outer shape of deployment bars, in accordance with the disclosure.

With reference to FIG. 1B, a deployment bar embodiment typically includes a passageway 112 axially disposed through a body 114 for allowing fluid communication between surface equipment and downhole tools. FIG. 1B is a cross sectional view of a deployment bar taken at centerline 1B and 1C of deployment bar 100. As depicted in FIG. 1C, also a cross sectional view of a deployment bar taken at centerline 1C, in some embodiments according to the disclosure, the deployment bar includes a plurality of passageways, 116, 118, and 120, isolated from one another when connected with other devices and in operation, where the passageways axially extend through a body 122 for such purposes as fluid communication, electrical communication, optical communication, data transmittance, and the like, between surface equipment and downhole tools. Within body 122, passageways, 116, 118, and 120, may be isolated by walls 124 and 126, also extending axially through body 122. In some aspects, passageway 116 may be used to accommodate a wireline or an electrical transmittance pathway with wireline connectability, and passageways 118 and 120 provide fluid communication between surface equipment and downhole tool(s). FIG. 1D illustrates a deployment bar connect with coiled tubing, or other connector, 128 and downhole tool 130 with passageways 116, 118, and 120, isolated from one another and contiguously passing through the deployment bar, coiled tubing, or other connector, 128 and downhole tool 130.

Figure 2:
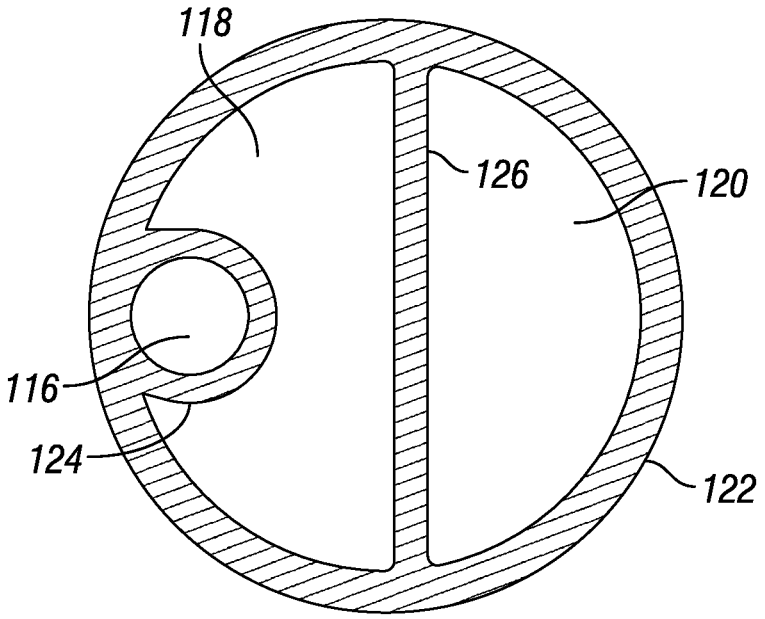
FIG. 2 illustrates a schematic radial cross-sectional view taken at cross section 2 of FIG. 1C.

An embodiment of one deployment bar according to the present disclosure is shown in FIG. 2 in a schematic radial cross-section taken at cross section 2 of FIG. 1C. As shown in FIG. 2, body 122, and walls 124 and 126 define passageways 116, 118 and 120. Passageways 116, 118 and 120 run continuous through the axial length of the deployment bar thus providing two flow passageways, 118 and 120, and accommodating at least one wire, optical fiber, or other data and/or power transmitting device through passageway 116. In some other aspects, passageway 116 could include the data and/or power transmitting device as a feature of the structure of the deployment bar, or in other aspects, the data and/or power transmitting device is passed through passageway 116 during the assembly and deployment of the coiled tubing and tool(s). The embodiment shown in FIG. 2 includes fluid passageway 120 depicted as a half circle, and passageway 118 a half circle with passageway 116 disposed therein. However, it is within the spirit and scope of the disclosure that any suitable shapes of passageways may be used, as embodiments generally include at least two flow passages and at least one wire, optical fiber, or other data and/or power transmitting passageway, notwithstanding any particular shape, or orientation of position relative the axial centerline of a deployment bar. For example, FIG. 3 illustrates another configuration of passageways extending through a deployment bar in a radial cross-section view.

Figure 3:
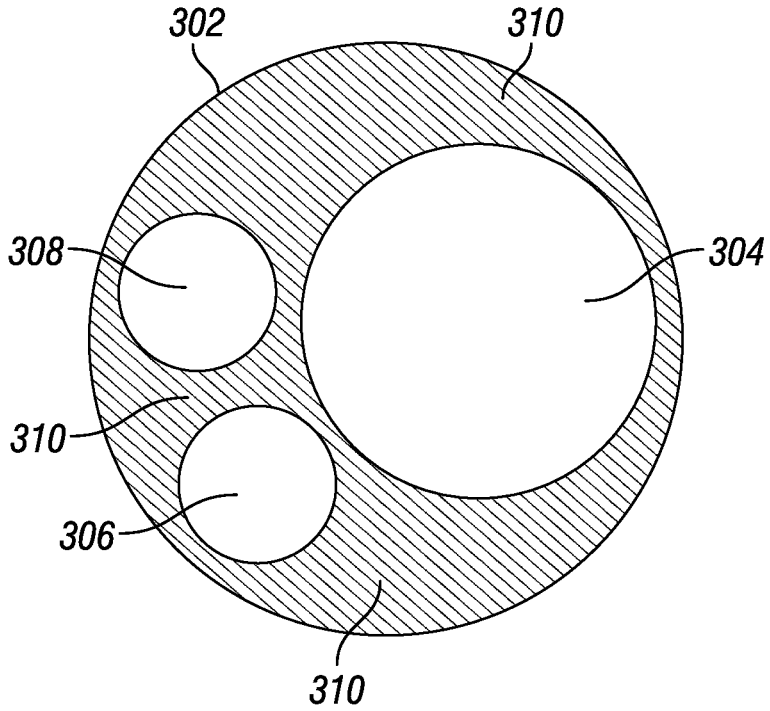
FIG. 3 shows one embodiment of a neck section of a deployment bar in a cross-sectional view, according to the disclosure.

With reference to FIG. 3, neck section 302, which may be similar to neck 102 shown in FIG. 1A, defines a large flow passage 304 therein. While the flow passage 304 is illustrated as substantially circular in cross-sectional shape, it may have any suitable cross-sectional shape. The neck section 302 further defines secondary flow passage 306 and one or more (one shown) passages 308 that may house electrical cable/conductors 412, or other wire, optical fiber, or other data and/or power transmitting device. Large flow passage 304, secondary flow passage 306 and passage 308 are isolated from one another by walls 310, all connected in a contiguous fashion.

Figure 4:
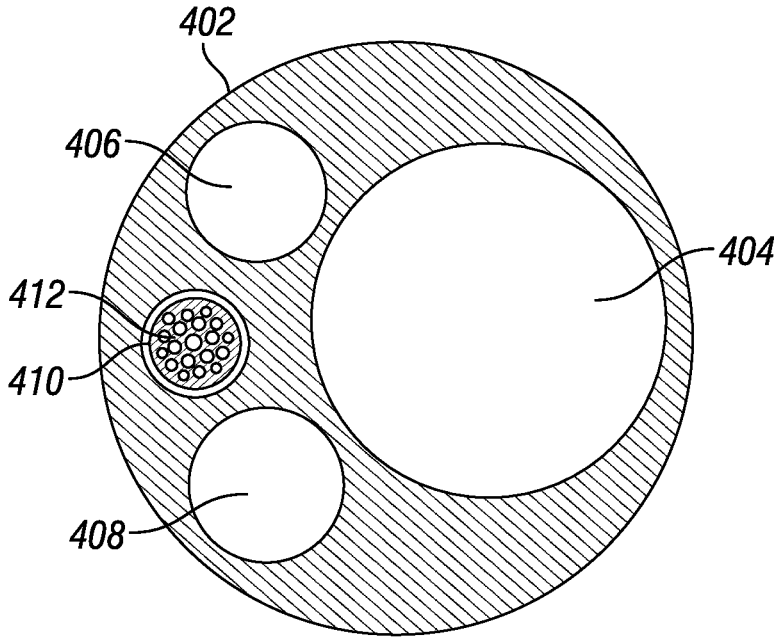
FIG. 4 depicts another embodiment of a deployment bar in a cross-sectional view of the neck section, in accordance with an aspect of the disclosure.

Another embodiment of a deployment bar according to the disclosure is shown in FIG. 4, in a schematic radial cross-section. Defined by the neck section 402, which may be similar to neck 102 shown in FIG. 1A, is a large flow passage 404. While the flow passage 404 is illustrated as substantially circular in cross-sectional shape, it may have any suitable cross-sectional shape. The neck section 402 further defines secondary flow passages 406 and 408 and one or more (one shown) electrical passages 410 that house electrical cable/conductors 412, or other wire, optical fiber, or other data and/or power transmitting device.

Figure 5:
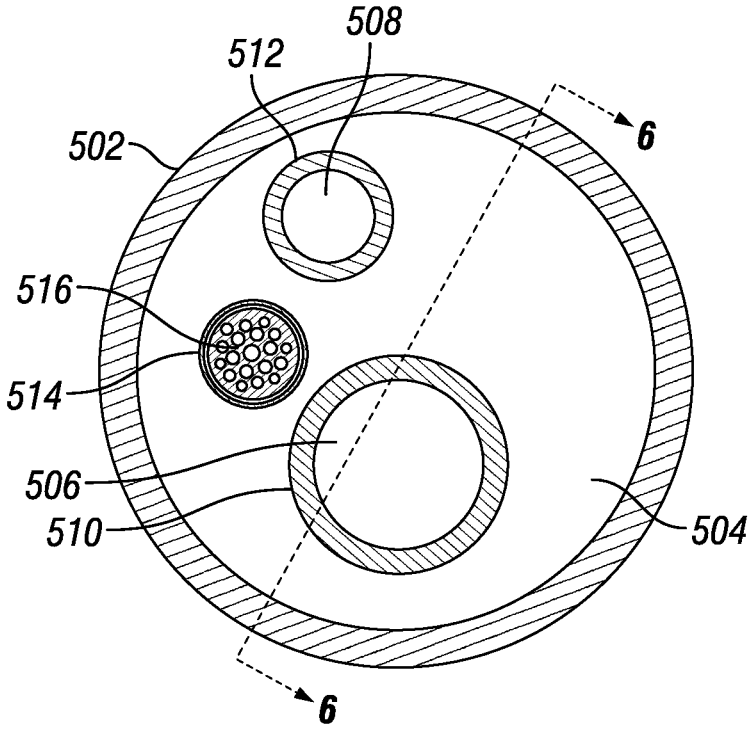
FIG. 5 shows another embodiment of a deployment bar in a cross-sectional view of the neck section, according to the disclosure.

Yet another embodiment of a deployment bar according to the disclosure is depicted in FIG. 5, in a schematic radial cross-sectional view as well. In this embodiment, a neck portion 502, which may be similar to neck 102 shown in FIG. 1A, has a main flow passage 504 that is substantially round and concentric with the diameter of the neck 502. The neck section 502 further contains secondary flow passages 506 and 508, which are defined within tubes 510 and 512, respectively. One or more passages 514 are also provided that contain electrical cable/conductors 516, or other wire, optical fiber, or other data and/or power transmitting device. The cable, wire, optical fiber, or other assembly 516 disposed in passage 514 may be provided with a sealing mechanism on opposing sides of neck portion 502 such that electrical, optical, and/or data connections may be made without exposing the conductors contained with passageway 514 to any fluid from passageways 506 and/or 508. In an embodiment, a cable, wire, optical fiber, or other assembly 516 is disposed directly in the main flow passage 504, i.e., not disposed in a separate passage 514 or the like. In some aspects, the conductors contained with passageway 514 arranged with a mechanical termination on both ends of the deployment bar in order to maintain sufficient tension, such that when sheared by a BOP ram or other device, the cable/conductors 516 are cut cleanly and substantially perpendicular to the longitudinal axis of the deployment bar.

Figure 6:
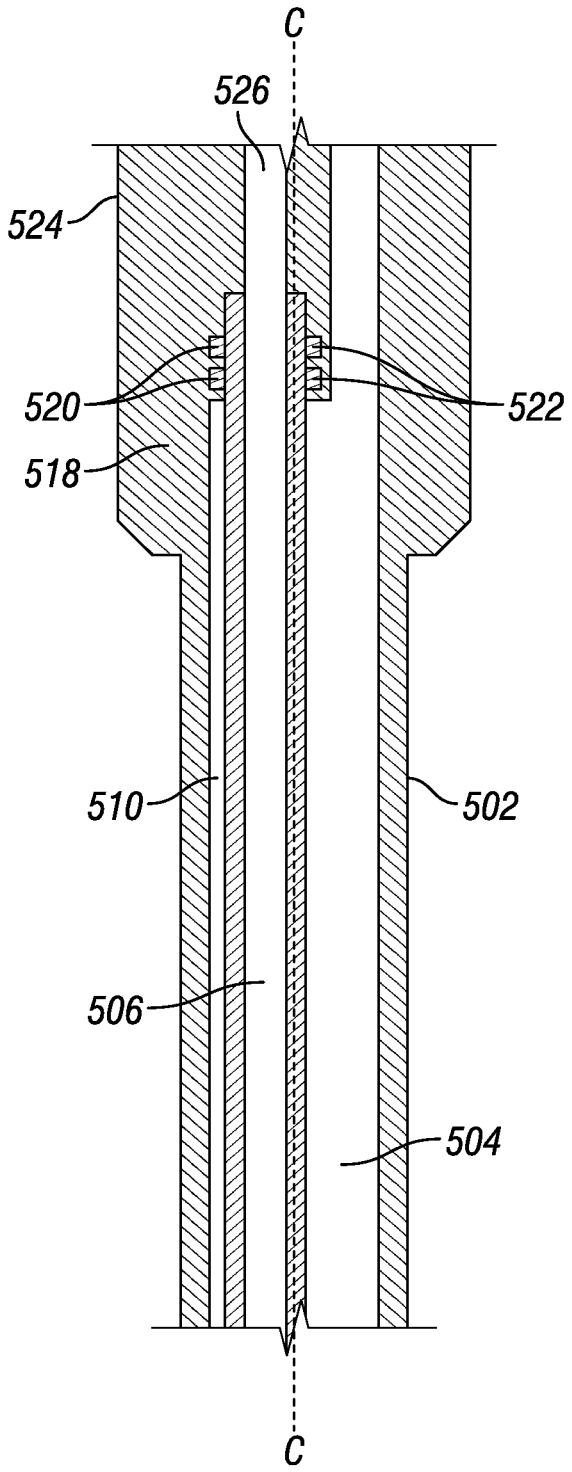
FIG. 6 depicts one end of a deployment bar is depicted in a schematic longitudinal cross-sectional view relative plane 'C' of the embodiment illustrated in FIG. 5, in accordance with an aspect of the disclosure.

With reference to FIG. 6, one end of a deployment bar is depicted in a schematic longitudinal cross-sectional view relative plane 'C' of the embodiment illustrated in FIG. 5. The deployment bar comprises a neck portion 502, and end portion 518, which defines an internal sealing region 520 including with o-rings 522 (two shown) that seal on the end of secondary passage tube 510, preventing fluid communication between the main passage 504 to the secondary passageway 506. A distal portion 524 of the deployment bar defines a passage 526 leading to the secondary passage 506. These passageways 506 and 526, though illustrated as substantially straight, may also be varied in longitudinal orientation, such as helically orientated, and the like, and in some cases may be combined together as a non-circular tube. Also, in some cases, multiple concentric tubes may be used. In some cases, a sealing region similar or like sealing region 520, is used for secondary passageway 508 to seal tube 512 with o-rings, thus preventing fluid communication between the main passage 504 to the secondary passageway 508, depicted in FIG. 5.

Embodiments according to the disclosure provide and use deployment bars that exhibit at least sufficient load carrying properties, both pressure induced and axial load, as well as sufficient shearability properties to ensure cutting which is clean, substantially perpendicular to the longitudinal axis of the deployment bar, and seals the higher pressure portion of the wellbore from the environment in the event that the wellbore needs to be sealed. Deployment bars according to the disclosure may also be optimized for shearability properties by minimizing total metal cross section, while maintaining sufficient load carrying properties. Further, in some aspects, such minimization may be localized to the shearing area to avoid reducing the collapse pressure of the bar.

Figure 7A:
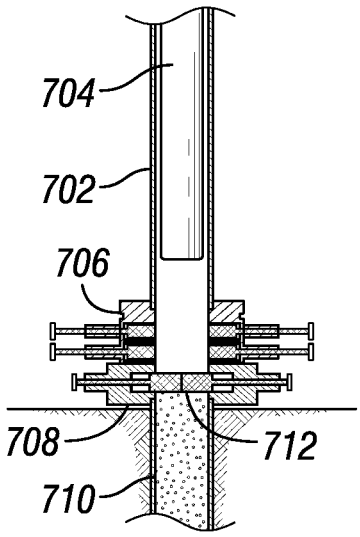
FIGS. 7A-7E illustrate deployment of coiled tubing tools into a wellbore deployment bars according to the disclosure; and, FIGS. 7F-7H depict shearing of deployment bars and sealing of the wellbore from the atmosphere, according to an aspect of the disclosure.

In some method embodiments according to the disclosure, downhole tools are lowered into a wellbore in sections, and hung off of the blowout preventer (BOP) sealing rams using a deployment bar, such as those described in FIGS. 1 through 6, that substantially matches the coiled tubing diameter, as shown in FIGS. 7A-7E. These deployment bar sections are placed in a riser and may be conveyed in by coiled tubing, wireline, slickline, and the like. In FIG. 7A, an assembly including a riser 702 and tool 704 disposed therein is placed over blowout preventer 706 and wellhead 708, which are situated over high pressure wellbore 710. Any suitable blow out preventer may be used, including, but not limited to, those blowout preventers disclosed in U.S. Provisional Patent Application Ser. No. 62/115,731, filed Feb. 13, 2015, and related continuity patent applications, each of which is incorporated in their entirety herein by reference thereto.

Referring again to FIG. 7A, high pressure wellbore 710 is sealed off by master valve 712, and then riser 702 connected to blowout preventer 706. At any point in this step or steps of the procedure described, if an unexpected differential pressure or other well control problem is detected across the sealing ram(s) 714 (two shown) resident in blowout preventer 706, a BOP control valve in fluid communication with sealing ram(s) 714 may close the sealing ram(s) 714 to isolate the higher pressure on the bottom of the blowout preventer 706 from the top of the blowout preventer 706.

Figure 7B:
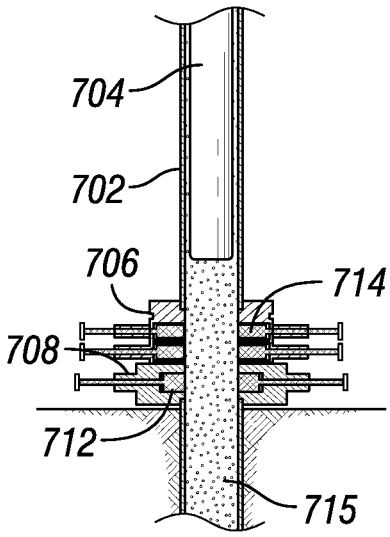
Figure 7C:
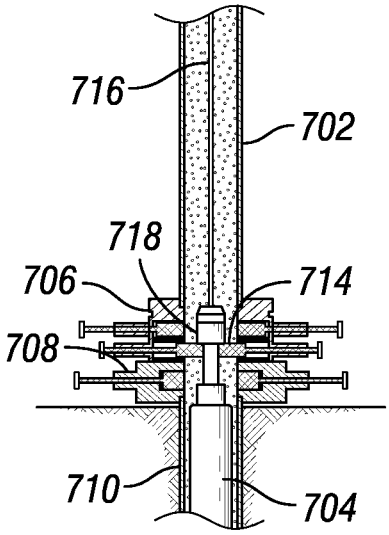
Figure 7D:
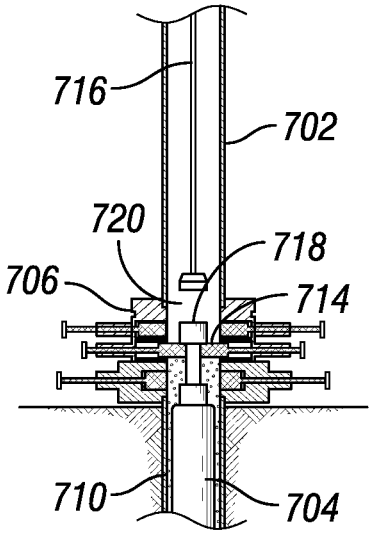

As shown in FIG. 7B, the wellhead or master valve 712 can then be opened, pressurizing the whole system to borehole pressure 715. As depicted in FIG. 7C, tool 704, sometimes referred to as a bottom hole assembly, may be passed through blowout preventer 706 and wellhead 708 and into high pressure wellbore 710 by conveyance 716, which may be one of coiled tubing, wireline, slickline and the like. In some aspects, a position sensor can be used to ensure accurate placement of the tool 704. The sealing ram(s) 714 may then be closed on the deployment bar 718 (such as those depicted in FIGS. 1 through 6 above) isolating well pressure below blowout preventer 706. As illustrated in FIG. 7D, the pressure above blowout preventer 706 is released 720, the riser 702 disconnected from the blowout preventer 706, and tool 704 suspended the wellbore 710 by sealing ram(s) 714 and deployment bar 718. Conveyance apparatus 716 may then be moved away from blowout preventer 706. The steps illustrated in FIGS. 7A through 7D may be repeated for one tool 704, or any of a plurality of tool 704 sections, required to be deployed into wellbore 710.

Figure 7E:
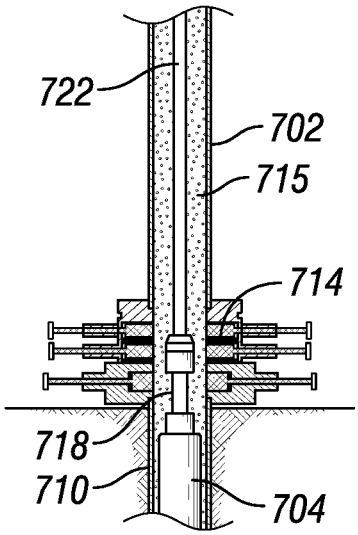

With reference to FIG. 7E, if not already made, coiled tubing 722 may be connected with tool 704, or string of tools 704, by deployment bar 718. Riser 702 is secured to blowout preventer 706 and sealing rams 714 then opened pressurizing the whole system to borehole pressure 715. Tool 704, or string of tools 704, may be conveyed through wellbore 710 by coiled tubing 722, and target operations conducted in the subterranean formation penetrated by wellbore 710.

Figure 7F:
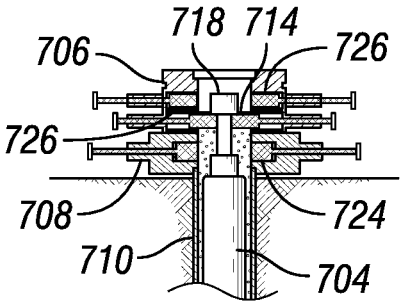

Referring now to FIG. 7F, as part of the contingency plans during wellbore activities, ability to close the master valve (s) 724 of the wellhead 708 is required. In order to achieve such while the downhole tool(s) 704 is suspended in the wellbore 710 from BOP sealing rams 714 by deployment bar 718, and without opening the well to atmosphere (thereby creating a so called blowout), the deployment bar 718 must be capable of being sheared by shear rams 726 (two shown) contained in BOP 706. Any suitable shear ram or shear/seal ram may be used, including, but not limited to, those rams disclosed in U.S. Provisional Patent Application Ser. No. 62/115,731, and related continuity patent applications, each of which incorporated in their entirety herein by reference thereto.

Figure 7G:
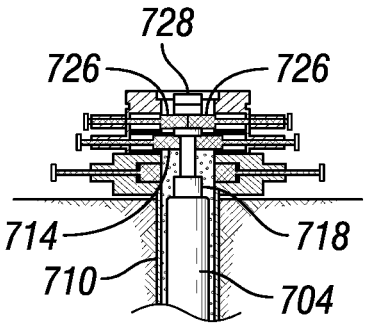
Figure 7H:
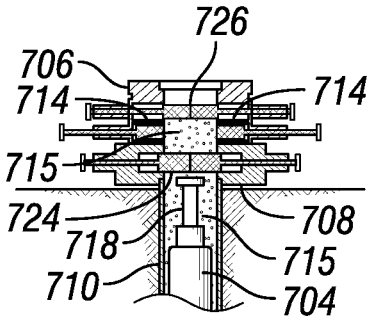

With reference to FIG. 7G, when activated under conditions where a blowout is probable to occur, shear rams 726 close upon and shear through deployment bar 718, while deployment bar 718 and tool(s) 704 are suspended by sealing rams 714. The deployment bar 718 may in some cases be connected to a conveyance device, while in some other cases, the deployment bar 718 is not connected to such a device, and only suspended by sealing rams 714. An upper portion 728 of deployment bar 718 is separated from the deployment bar, and cut. A clean cut is made substantially perpendicular to the longitudinal axis of the deployment bar, and contents therein, by the shearing force of shear rams 726. As depicted in FIG. 7H, once deployment bar 718 is sheared and shear rams 726 closed forming a secure seal of the wellbore pressure 714 from the atmosphere, sealing rams 714 are opened, or otherwise retracted into BOP 706, and the remainder of deployment bar 718 and tool(s) 704 dropped into the wellbore 710. Master valve(s) 724 of wellhead 708 are then closed to shut-in wellbore 710. Alternatively, a combination of shear and seal rams may be employed to shear the deployment bar and/or shut-in the wellbore.

The foregoing description of the embodiments has been provided for purposes of illustration and description. Example embodiments are provided so that this disclosure will be sufficiently thorough, and will convey the scope to those who are skilled in the art. Numerous specific details are set forth such as examples of specific components, devices, and methods, to provide a thorough understanding of embodiments of the disclosure, but are not intended to be exhaustive or to limit the disclosure. It will be appreciated that it is within the scope of the disclosure that individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Also, in some example embodiments, well-known processes, well-known device structures, and well-known technologies are not described in detail. Further, it will be readily apparent to those of skill in the art that in the design, manufacture, and operation of apparatus to achieve that described in the disclosure, variations in apparatus design, construction, condition, erosion of components, gaps between components may present, for example.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly. In the figures illustrated, the orientation of particular components is not limiting, and are presented and configured for an understanding of some embodiments of the disclosure.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. An apparatus for deploying a tool into a wellbore, the apparatus comprising:

a deployment bar having:

a neck portion extending between end connections, wherein the end connections are configured to be attached to the tool and to a coiled tubing tool string, respectively; and, a main flow passage extending in an axial direction through the neck portion and the end connections and at least one electrical device passageway extending in an axial direction through the neck portion and the end connections, the at least one electrical device passageway being kept separated from the main flow passage, wherein the apparatus is shearable by at least one shearing ram disposed in a blowout preventer to provide a clean cut which is substantially perpendicular to the longitudinal axis of the apparatus, and wherein the main flow passage is substantially open to the well bore, and wherein the shearing ram seals the pressure of the wellbore from the atmosphere after the clean cut.

2. The apparatus of claim 1 further comprising at least one secondary flow passage.

3. The apparatus of claim 2 wherein well treatment fluid flows from the wellbore through the at least one secondary flow passage.

4. The apparatus of claim 3 wherein the at least one secondary flow passage has a substantially circular cross sectional shape.

5. The apparatus of claim 4 wherein the at least one secondary flow passage is a tube disposed within the main flow passage.

6. The apparatus of claim 4 wherein the electrical device passageway is a tube disposed within the main flow passage.

7. The apparatus of claim 2 wherein the main flow passage, the at least one secondary flow passage and the electrical device passageway are isolated by contiguous walls.

8. The apparatus of claim 2 wherein the at least one secondary flow passage is a plurality of flow passages being defined by a plurality of secondary tubes disposed within the main flow passage.

9. The apparatus of claim 2 wherein the at least one secondary flow passage is a tube having an end which seals in a sealing region within at least one of the end connections.

10. The apparatus of claim 2 wherein the at least one secondary flow passage is a tube having at least one end which seals in a sealing region within at least one of the end connections.

11. The apparatus of claim 1 wherein a wireline cable is disposed in the electrical device passageway.

12. The apparatus of claim 1 wherein an optical fiber is disposed in the electrical device passageway.

13. The apparatus of claim 1 wherein well treatment fluid flows through the main flow passage.

14. The apparatus of claim 1 wherein a diameter of the neck portion is sized to conform to the diameter of the coiled tubing.

15. A method comprising:

providing a deployment bar comprising a neck portion extending between a first and a second end connection, a main flow passage extending through the neck portion and the first and second end connections, and at least one electrical device passageway extending through the neck portion and the first and second end connections separately from the main flow passage, wherein the end connections are configured to be attached to a coiled tubing tool string;

attaching a tool to the first end connection of the deployment bar;

introducing the deployment bar and the tool into a blow out preventer, a wellhead and a wellbore, wherein the deployment bar is shearable by at least one shearing ram disposed in the blowout preventer;

securing the deployment bar with one or more sealing rams contained with the blow out preventer;

attaching the coiled tubing tool string to the second end connection of the deployment bar; and, deploying the coiled tubing tool string, the deployment bar and the tool into the wellbore.

16. The method of claim 15 wherein the deployment bar further comprises at least one secondary flow passage.

17. The method of claim 16 further comprising pumping well treatment fluid into the wellbore through the main flow passage, transmitting a second fluid through the at least one secondary flow passage, and providing power to the tool through a wireline cable disposed in the least one electrical device passageway.

18. A method comprising:

providing an apparatus comprising a neck portion extending between a first and a second end connection, wherein the end connections are configured to be attached to a coiled tubing tool string, and a main flow passage, at least one secondary flow passage and at least one electrical device passageway; the main flow passage, the at least one secondary flow passage, and the at least one electrical device passageway extending through the neck portion and the end connections isolated from each other;

attaching a tool to the first end connection of the apparatus;

introducing the apparatus and the tool into a blow out preventer, a wellhead and a wellbore;

securing the apparatus with one or more sealing rams contained with the blow out preventer; and, shearing the apparatus by at least one shearing ram disposed in the blowout preventer to provide a clean cut which is substantially perpendicular to the longitudinal axis of apparatus, and wherein the shearing ram seals the pressure of the wellbore from the atmosphere.

19. The method of claim 18 further comprising opening the one or more sealing rams dropping the tool and apparatus into the wellbore.

20. The method of claim 19 further comprising closing at least one master valve disposed in the wellhead.

21. The method of claim 18 further comprising attaching the coiled tubing tool string to the second end connection of the apparatus prior to shearing the apparatus.

* * * * *